US011205880B1

(12) United States Patent
Zhou

(10) Patent No.: US 11,205,880 B1
(45) Date of Patent: Dec. 21, 2021

(54) SOCKET AND DOOR WITH SAME

(71) Applicant: SHANGHAI IMILAB TECHNOLOGY CO., LTD., Shanghai (CN)

(72) Inventor: Xuegang Zhou, Shanghai (CN)

(73) Assignee: SHANGHAI IMILAB TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/371,087

(22) Filed: Jul. 8, 2021

(30) Foreign Application Priority Data

Oct. 13, 2020 (CN) ..... 202011090526.5

(51) Int. Cl.
*H01R 13/66* (2006.01)
*H01R 13/703* (2006.01)
*E05B 47/00* (2006.01)

(52) U.S. Cl.
CPC ..... *H01R 13/665* (2013.01); *H01R 13/703* (2013.01); *E05B 47/0001* (2013.01)

(58) Field of Classification Search
CPC .... H01R 13/665; H01R 13/66; H01R 13/703; H01R 13/70
USPC ..... 439/620.22
See application file for complete search history.

(56) References Cited

U.S. PATENT DOCUMENTS 4,720,155 A * 1/1988 Schildkraut ..... H05K 9/0007 439/108
5,486,725 A * 1/1996 Keizer ..... F24C 7/08 307/116
5,572,441 A * 11/1996 Boie ..... G06K 7/10326 307/109
5,818,710 A * 10/1998 LeVan Suu ..... H02J 13/0005 700/12
6,302,707 B1 * 10/2001 Kolar ..... H05K 5/0069 439/76.1
7,168,989 B2 * 1/2007 Faulkner ..... H01R 31/065 439/620.22
9,577,388 B2 * 2/2017 Umetsu ..... H01R 13/6608
10,483,796 B2 * 11/2019 Wan ..... H01R 13/7038
10,727,731 B1 * 7/2020 King ..... H04L 51/20
10,958,020 B1 * 3/2021 King ..... H05B 47/10
10,965,068 B1 * 3/2021 King ..... H01R 31/06
2004/0084972 A1 * 5/2004 Weng ..... H02J 13/0075 307/140
2008/0258563 A1 * 10/2008 Hodges ..... H01R 13/703 307/112

(Continued)

*Primary Examiner* — Harshad C Patel
(74) *Attorney, Agent, or Firm* — Fideli Law PLLC

(57) ABSTRACT

A socket includes: an input terminal configured to be electrically connected to an AC power source; an output terminal configured to output an AC signal of the AC power supply; a switch circuit electrically connected between the input terminal and the output terminal; a step-down circuit electrically connected to the input terminal and configured to reduce the amplitude of the AC signal; a shaping circuit electrically connected to the step-down circuit and configured to convert the AC signal with reduced amplitude into a shaped signal; and a control circuit electrically connected to the shaping circuit and the switch circuit and configured to control the switch circuit based on the shaping signal to enable the switch circuit performs switching operation only when the AC signal is at zero potential. A door includes the socket.

20 Claims, 12 Drawing Sheets

(56) References Cited

U.S. PATENT DOCUMENTS

| | | | | |
|---|---|---|---|---|
| 2009/0068893 | A1* | 3/2009 | Busse | H04Q 1/142<br>439/620.22 |
| 2012/0293153 | A1* | 11/2012 | Garb | G06F 1/266<br>323/311 |
| 2013/0109317 | A1* | 5/2013 | Kikuchi | H01P 1/208<br>455/41.2 |
| 2015/0373796 | A1* | 12/2015 | Bahrehmand | H05B 47/19<br>315/129 |
| 2016/0204554 | A1* | 7/2016 | Yasuda | G02B 6/42<br>439/620.22 |

* cited by examiner

SOCKET AND DOOR WITH SAME

RELATED APPLICATIONS

This application claims priority to Chinese Application number 202011090526.5, filed on Oct. 13, 2020, which is incorporated herein by reference.

TECHNICAL FIELD

The present disclosure relates to the field of electrical appliances, in particular to a socket and a door with the same.

BACKGROUND

At present, relays are widely used to control the power output in smart socket. When the contacts of relays are under load, sparks may occur at the moment of attraction or release. Under the condition of heavy load, this is very likely to cause contact melting, which may lead to relay adhesion and failure, and affect the service life of the whole smart socket.

Therefore, there is a need for an improved smart socket.

BRIEF SUMMARY

In view of the above-mentioned shortcomings, the technical problem to be solved by one or more embodiments of this disclosure is to prevent the switching device in the smart socket from having sparks at the moment of attraction or release.

According to some aspects of the present disclosure, a socket is provided, including: an input terminal configured to be electrically connected to an AC power source; an output terminal configured to output an AC signal; a switch circuit electrically connected between the input terminal and the output terminal; a step-down circuit electrically connected to the input terminal and configured to reduce the amplitude of the AC signal; a shaping circuit electrically connected to the step-down circuit and configured to convert the AC signal with reduced amplitude into a shaped signal; and a control circuit electrically connected to the shaping circuit and the switch circuit and configured to control the switch circuit based on the shaping signal to enable the switch circuit to perform switching operation only when the AC signal is at zero potential.

According to some aspects of the present disclosure, a door is provided, including: a door frame for fixing to a wall; a door body connected to the door frame by a hinge to enable the door body to pivot between an open position and a closed position relative to the door frame; and a socket, the socket including: an input terminal configured to be electrically connected to an AC power source; an output terminal configured to output an AC signal; a switch circuit electrically connected between the input terminal and the output terminal; a step-down circuit electrically connected to the input terminal and configured to reduce the amplitude of the AC signal; a shaping circuit electrically connected to the step-down circuit and configured to convert the AC signal with reduced amplitude into a shaped signal; and a control circuit electrically connected to the shaping circuit and the switch circuit and configured to control the switch circuit based on the shaping signal to enable the switch circuit to perform switching operation only when the AC signal is at zero potential.

In addition, the above summary does not enumerate all the essential features of the present disclosure. In addition, sub-combinations of these feature groups may also constitute inventions.

BRIEF DESCRIPTION OF THE DRAWINGS

In order to explain the technical solutions in the disclosure, the following will briefly introduce the drawings needed in the embodiment description. Obviously, the drawings in the following description are only some exemplary embodiments of the disclosure. For those skilled in the art, other drawings may be obtained according to these drawings without creative labor.

DETAILED DESCRIPTION

The following description provides the specific disclosure scenarios and requirements of this disclosure in order to enable those skilled in the art to make or use the contents of this disclosure. Various modifications to the disclosed embodiments will be apparent to those skilled in the art, and the general principles defined herein may be applied to other embodiments and s without departing from the scope of this disclosure. Therefore, this disclosure is not limited to the illustrated embodiments, but is to be accorded the widest scope consistent with the claims.

In this disclosure, the term "outside" refers to the outside of an enclosed space formed by a door mounted to a wall in a closed state, and the term "inside" refers to the inside of an enclosed space formed by a door mounted to a wall in a closed state. Outside the house may also be called outdoor, and inside the house may also be called indoor.

Figure 1:
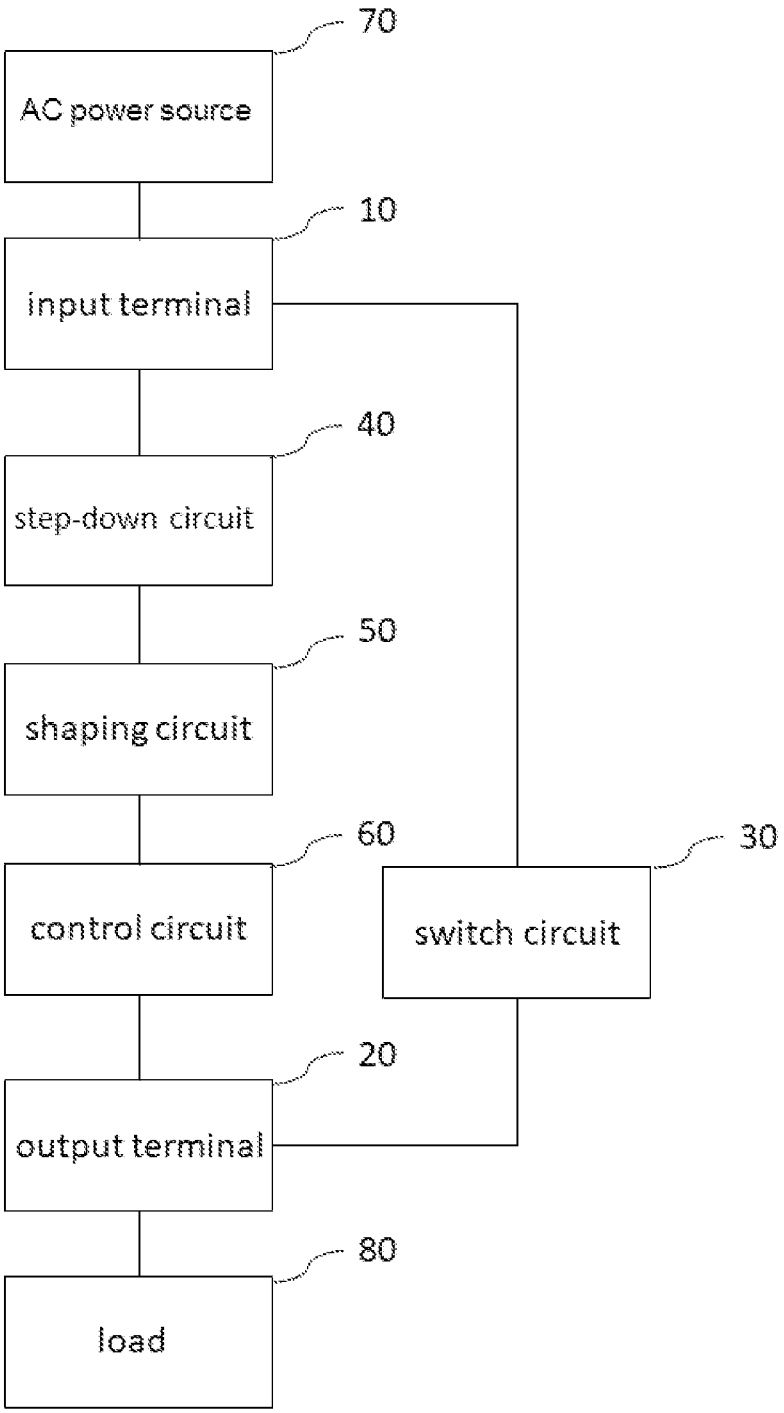
FIG. 1 is a schematic structural diagram of a socket according to one or more embodiments of the present disclosure.

FIG. 1 is a schematic structural diagram of a socket according to one or more embodiments of the present disclosure.

As shown in FIG. 1, a socket 100 may include an input terminal 10, an output terminal 20, a switch circuit 30, a step-down circuit 40, a shaping circuit 50 and a control circuit 60. The input terminal 10 may be configured to be electrically connected to an AC power source 70 (e.g., a municipal power grid). The output terminal 20 may be configured to output an AC signal (e.g., AC voltage) to a load 80 under the action of the switch circuit 30. The switch circuit 30 may be electrically connected between the input terminal 10 and the output terminal 20 and configured to control connection and disconnection between the input terminal 10 and the output terminal 20. The step-down circuit 40 may be electrically connected to the input terminal 10 and configured to reduce the amplitude of the AC signal. The shaping circuit 50 may be electrically connected to the step-down circuit 40 and configured to convert the AC signal with reduced amplitude into a shaped signal. The control circuit 60 may be electrically connected to the shaping circuit 50 and the switch circuit 30 and configured to control the switch circuit 30 based on the shaping signal to enable the switch circuit 30 performs switching operation only when the AC signal is at zero potential.

Figure 2:
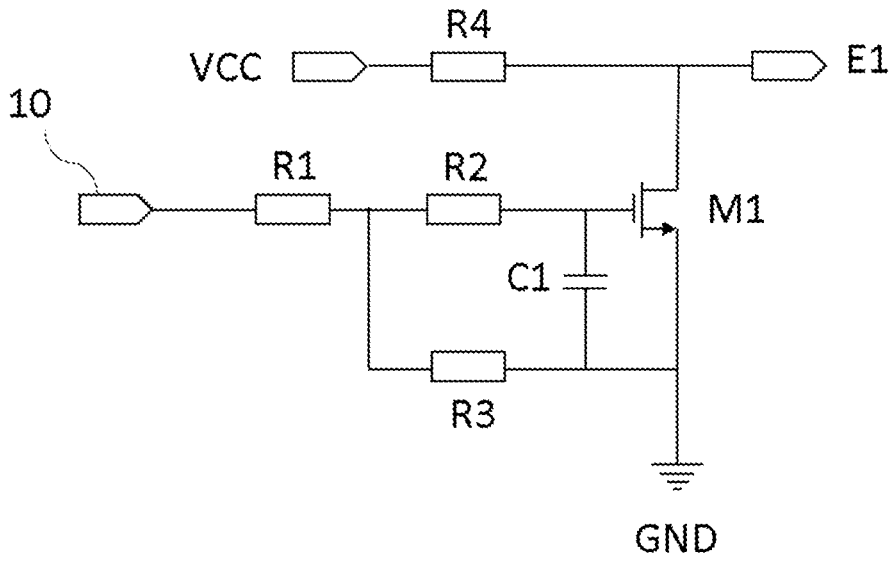
FIG. 2 is a schematic structural diagram of a step-down circuit and a shaping circuit according to one or more embodiments of the present disclosure.

FIG. 2 is a schematic structural diagram of a step-down circuit and a shaping circuit according to one or more embodiments of the present disclosure.

As shown in FIG. 2, the step-down circuit 40 may be configured to reduce the amplitude of the AC signal by dividing the AC signal from the AC power supply. In some embodiments, the amplitude of the reduced AC signal is 1% of the amplitude of the original AC signal. For example, the amplitude of the original AC signal is 220V, and the amplitude of the reduced AC signal may be 2.2V. The step-down circuit 40 may include a first resistor R1 and a second resistor R2. A first end of the first resistor R1 may be electrically connected to the input terminal 10. A first end of the second resistor R2 may be electrically connected to a second end of the first resistor R1, and the second end of the second resistor R2 may be grounded. The resistance of the second resistor R2 may be 0.5% to 1.5% of the resistance of the first resistor R1, for example, 1%. For example, the resistance of the first resistor R1 may be 1000 KΩ, and the resistance of the second resistor R2 may be 10 KΩ.

As shown in FIG. 2, the shaping circuit 50 may be configured to shape the stepped-down AC signal so as to transform the sinusoidal waveform of the AC signal into a shaped signal (e.g., a square wave) and remove the negative half-cycle waveform. The shaping circuit 50 may include an NMOSFET(N-type Metallic Oxide Semiconductor Field Effect Transistor) M1, a third resistor R3, a fourth resistor R4 and a first capacitor C1. A source of the NMOSFET M1 may be grounded, a drain of the NMOSFET M1 may be electrically connected to an output E1 of the shaping circuit 50, and the output E1 of the shaping circuit 50 is connected to the control circuit 60. The first end of the third resistor R3 may be electrically connected to the first end of the second resistor R2, and the second end of the third resistor R3 may be electrically connected to the gate of the NMOSFET M1. The first end of the fourth resistor R4 may be electrically connected to the operating voltage VCC (e.g., 3.3V), and the second end of the fourth resistor R4 may be electrically connected to the drain of the NMOSFET M1. The first end of the first capacitor C1 is electrically connected to the gate of the NMOSFET M1. A second end of the first capacitor C1 may be grounded. For example, the resistance of the third resistor R3 may be 10 KΩ, the resistance of the fourth resistor R4 may be 10 KΩ, and the capacitance of the first capacitor C1 may be 100 nF. By shaping with NMOSFET M1, the delay time may be determined by the shaped signal, eliminating the need for a phase detection circuit.

Figure 3:
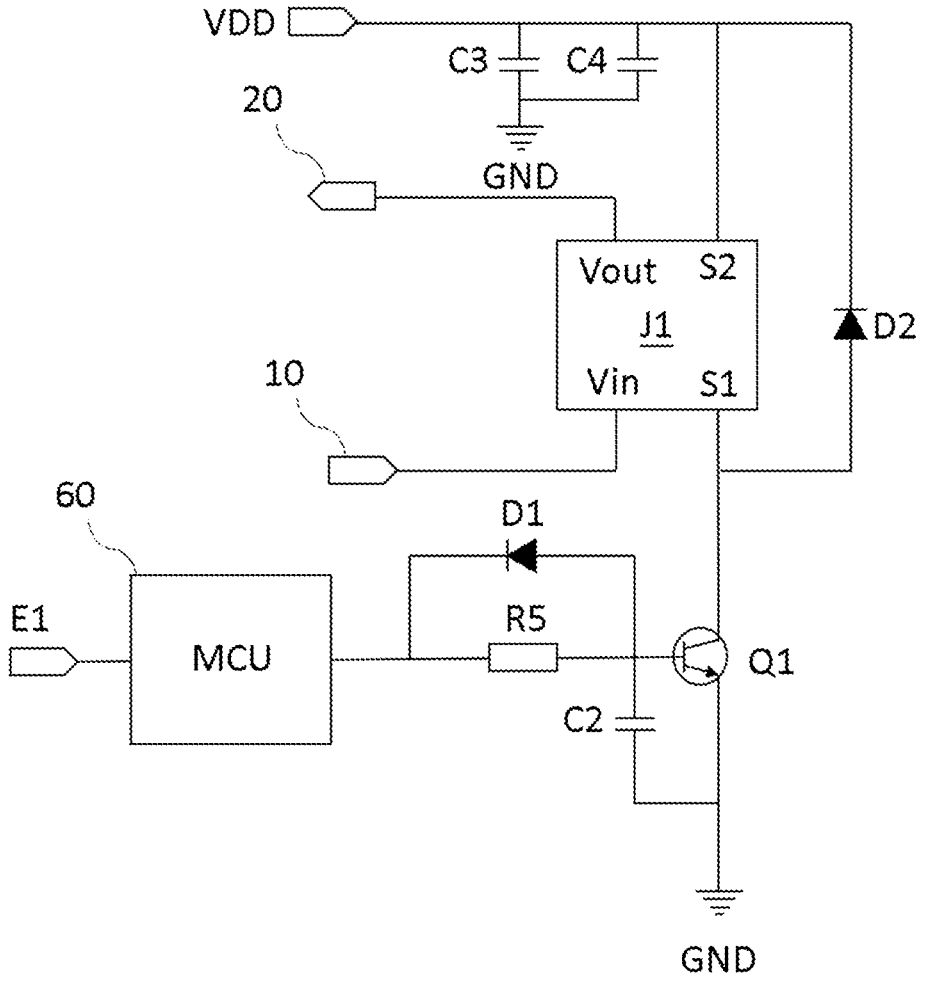
FIG. 3 is a schematic structural diagram of a switch circuit according to one or more embodiments of the present disclosure.

FIG. 3 is a schematic structural diagram of a switch circuit according to one or more embodiments of the present disclosure.

As shown in FIG. 3, the switch circuit 30 may include a relay J1, a triode Q1, a fifth resistor R5, a first diode D1, a second diode D2, a second capacitor C2, a third capacitor C3 and a fourth capacitor C4. The AC signal input end Vin of relay J1 may be electrically connected to input terminal 10, the AC signal output end Vout of relay J1 may be electrically connected to output terminal 20, and first control end S1 of relay J1 is connected to working voltage VDD (e.g., 5V). A collector of the triode Q1 may be electrically connected to the second control end S2 of the relay J1, and an emitter of the triode Q1 may be grounded. When a current is generated between the first control end S1 and the second control end S2 of the relay J1, a coil in the relay J1 generates magnetic force to actuate the contacts in the relay J1, thereby controlling the contacts to be attracted or released. A first end of the fifth resistor R5 may be electrically connected to the control signal output of the control circuit 60, and a second end of the fifth resistor R5 may be electrically connected to the base of the transistor Q1. The anode of the first diode D1 may be electrically connected to the second end of the fifth resistor R5, and the cathode of the first diode D1 may be electrically connected to the first end of the fifth resistor R5. The anode of the second diode D2 may be electrically connected to the second control end S2 of the relay J1, and the cathode of the second diode D2 may be electrically connected to the first control end S1 of the relay J1. A first end of the second capacitor C2 may be electrically connected to a second end of the fifth resistor R5, and the second end of the second capacitor C2 may be grounded. A first end of the third capacitor C3 may be electrically connected to an operating voltage VDD (e.g., 5V), and a second end of the third capacitor C3 may be grounded. A first end of the fourth capacitor C4 may be electrically connected to an operating voltage VDD (e.g., 5V), and a second end of the fourth capacitor C4 may be grounded. For example, the resistance of the fifth resistor R5 may be 10 KΩ, the capacitance of the second capacitor C2 may be 10 μF, the capacitance of the third capacitor C3 may be 10 μF, and the capacitance of the fourth capacitor C4 may be 100 nF.

As shown in FIG. 3, the control circuit 60 may be configured to generate a control signal based on the shaping signal. The control signal is used to control the relay J1 to enable a voltage difference is generated between the first control end S1 and the second control end S2 of the relay J1, thereby generating a current in the internal coil of the relay J1, so as to control the contacts of the relay J1 to be attracted or released only when the AC signal is near zero potential (0° or 180° phase), so as to avoid the ignition phenomenon. The control circuit 60 may include a processing unit, which may be a single chip microcomputer, a central processing unit (CPU), a microprocessor (MPU), a microcontroller (MCU), a field programmable gate array (FPGA), a programmable logic controller (PLC), an application specific integrated circuit (ASIC), and other circuit structures or electronic devices capable of generating the control signal based on the shaped signal. The control circuit 60 may include an input for receiving the shaped signal output from the shaping circuit 50 and an output for sending the control signal generated based on the shaped signal to the switch circuit 30.

In some embodiments, the socket 100 may further include a first phase detection circuit and a second phase detection circuit. The first phase detection circuit may be electrically connected to the gate of the NMOSFET M1 and configured to detect the phase of the AC signal. The second phase detection circuit may be electrically connected to the drain of the NMOSFET M1 and configured to detect the phase of the shaped signal. The first phase detection circuit and the second phase detection circuit may be electrically connected to the control circuit 60 to send the detected phase data to the control circuit 60. In some embodiments, the first phase detection circuit and the second phase detection circuit may be part of the control circuit 60.

The control signal includes a first trigger edge and a second trigger edge, the first trigger edge is used for triggering the contact of the relay to attract, and the second trigger edge is used for triggering the release of the contact of the relay, the appearance time of the first trigger edge is determined according to the zero crossing time of the AC signal, the transition time of the shaped signal and the attracting transition time of the relay, the appearance time of the second trigger edge is determined according to the zero crossing time of the AC signal, the transition time of the shaped signal and the release transition time of the relay. The first trigger edge may be a rising edge or a falling edge. The second trigger edge may be a rising edge or a falling edge. For example, when the contact of relay J1 is a normally open contact, the first trigger edge may be a rising edge and the second trigger edge may be a falling edge. For example, when the contact of relay J1 is normally closed, the first trigger edge may be a falling edge and the second trigger edge may be a rising edge.

Figure 4:
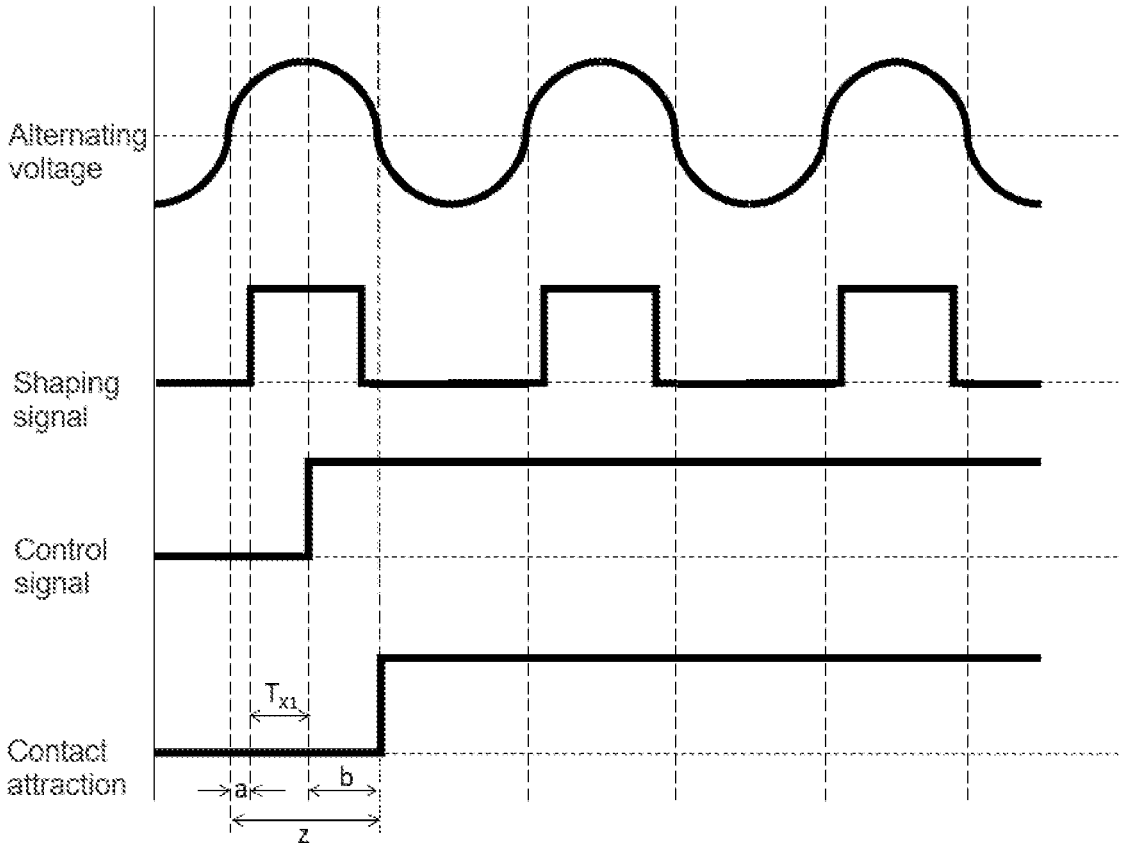
FIG. 4 is a waveform timing diagram of voltage according to one or more embodiments of this disclosure.

FIG. 4 is a waveform timing diagram of voltage according to one or more embodiments of this disclosure.

As shown in FIG. 4, the delay time of the first trigger edge compared with the rising edge of the shaped signal is calculated according to the following formula:

$$T_{x1}=n\times z-a-b,$$

where $T_{y1}$ is the delay time between the first trigger edge and the rising edge of the shaped signal, a is the time between the zero crossing time of the AC signal from negative half cycle to positive half cycle and the rising edge time of the shaped signal in the positive half cycle, z is the half cycle of the AC signal, b is the attracting transition time of the relay, and n is a positive integer.

It may be seen that by selecting the delay amount of the first trigger edge of the control signal relative to the rising edge of the shaping signal, the relay J1 may be near the zero potential (e.g., 180° phase point) of the AC signal at the moment of attracting, thus avoiding arc discharge and protecting the relay from damage.

Figure 5:
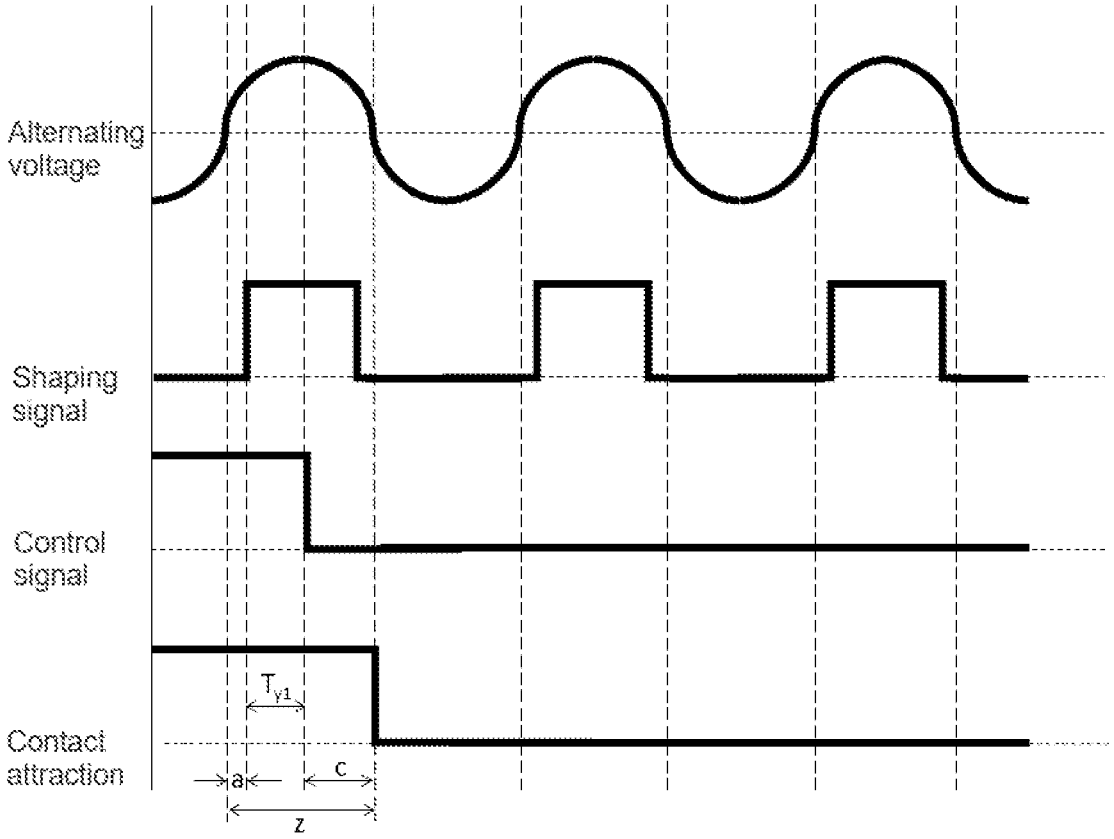
FIG. 5 is a waveform timing diagram of voltage according to one or more embodiments of this disclosure.

FIG. 5 is a waveform timing diagram of voltage according to one or more embodiments of this disclosure.

As shown in FIG. 5, the delay time of the first trigger edge compared with the falling edge of the shaped signal is calculated according to the following formula:

$$T_{y1}=n\times z+a-b,$$

where $T_{y1}$ is the delay time between the first trigger edge and the falling edge of the shaped signal, a is the time between the zero-crossing time of the AC signal from negative half-cycle to positive half-cycle and the rising edge time of the shaped signal in the positive half-cycle, z is the half-cycle of the AC signal, b is the attract transition time of the relay, and n is a positive integer.

It may be seen that by selecting the delay amount of the first trigger edge of the control signal relative to the falling edge of the shaping signal, the relay J1 may be near the zero potential (e.g., 0° phase point) of the AC signal at the moment of attraction, thus avoiding the arc discharge phenomenon and protecting the relay from damage.

Figure 6:
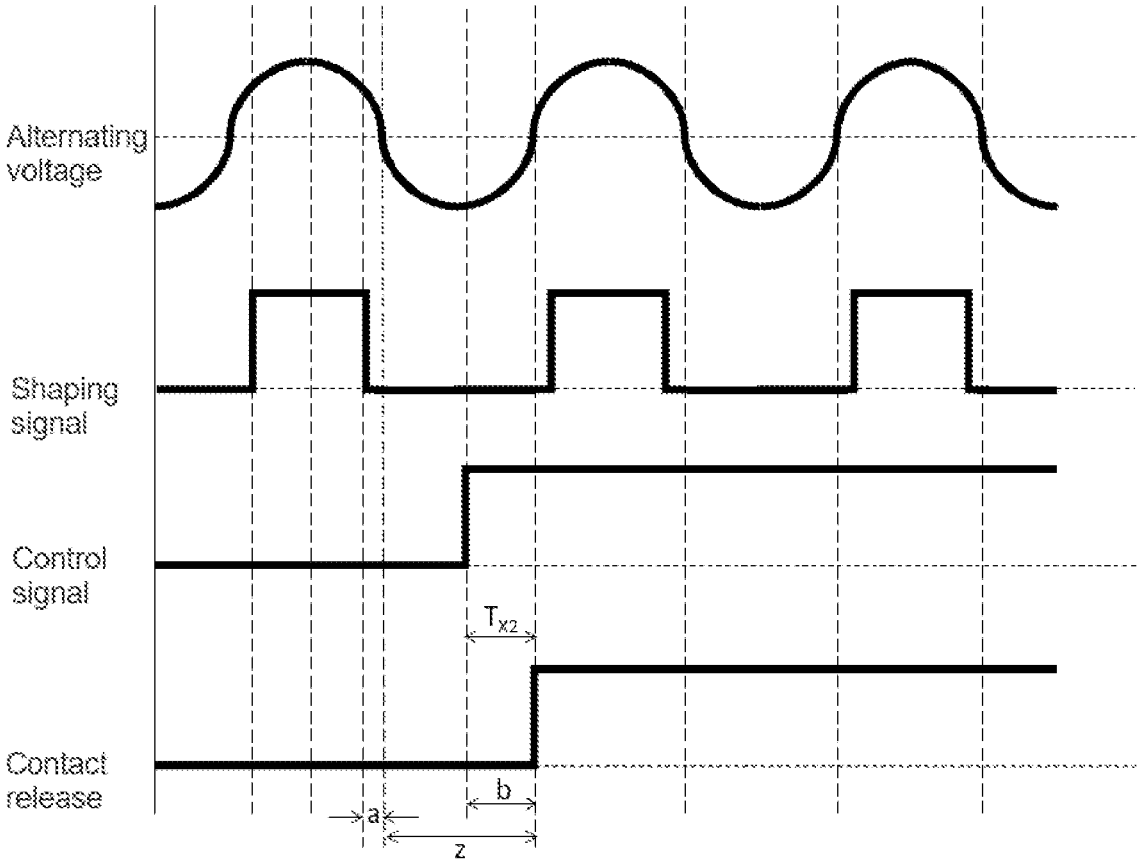
FIG. 6 is a waveform timing diagram of voltage according to one or more embodiments of this disclosure.

FIG. 6 is a waveform timing diagram of voltage according to one or more embodiments of this disclosure.

As shown in FIG. 6, the delay time of the second trigger edge compared with the rising edge of the shaped signal is calculated according to the following formula:

$$T_{x2}=n\times z-a-c,$$

where $T_{x2}$ is the delay time of the second trigger edge compared with the rising edge of the shaped signal, a is the time between the zero-crossing time of the AC signal from negative half cycle to positive half cycle and the rising edge time of the shaped signal in the positive half cycle, z is the half cycle of the AC signal, c is the release transition time of the relay, and n is a positive integer.

It may be seen that by selecting the delay amount of the second trigger edge of the control signal relative to the rising edge of the shaping signal, the relay J1 may be near the zero potential (e.g., 180° phase point) of the AC signal at the moment of release, thus avoiding arc discharge and protecting the relay from damage.

Figure 7:
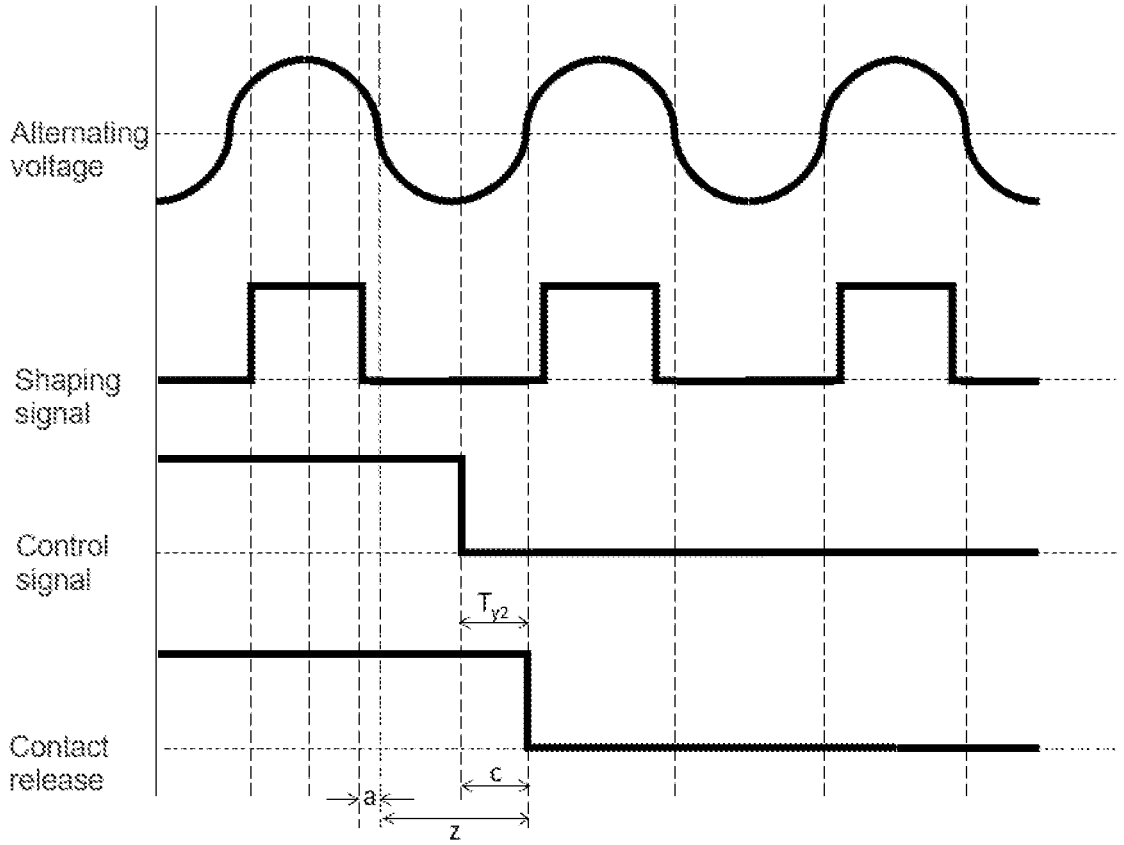
FIG. 7 is a waveform timing diagram of voltage according to one or more embodiments of this disclosure.

FIG. 7 is a waveform timing diagram of voltage according to one or more embodiments of this disclosure.

As shown in FIG. 7, the delay time of the second trigger edge compared with the falling edge of the shaped signal is calculated according to the following formula:

$$T_{y2}=n\times z+a-c,$$

where $T_{y2}$ is the delay time between the second trigger edge and the falling edge of the shaped signal, a is the time between the zero-crossing time of the AC signal from negative half-cycle to positive half-cycle and the rising edge time of the shaped signal in the positive half-cycle, z is the half-cycle of the AC signal, c is the release transition time of the relay, and n is a positive integer.

It may be seen that by selecting the delay amount of the second trigger edge of the control signal relative to the falling edge of the shaping signal, the relay J1 may be near the zero potential (e.g., 0° phase point) of the AC signal at the moment of release, thus avoiding the arc discharge phenomenon and protecting the relay from damage.

It should be noted that one or more of the above embodiments take the case where the contact of relay J1 is normally open and the actuation level is high as an example. For the case where the contact is normally closed and the actuation level is low, the high level and the low level of the control signal are mutually switched. This technical scheme should also fall within the protection scope of this disclosure.

Figure 8:
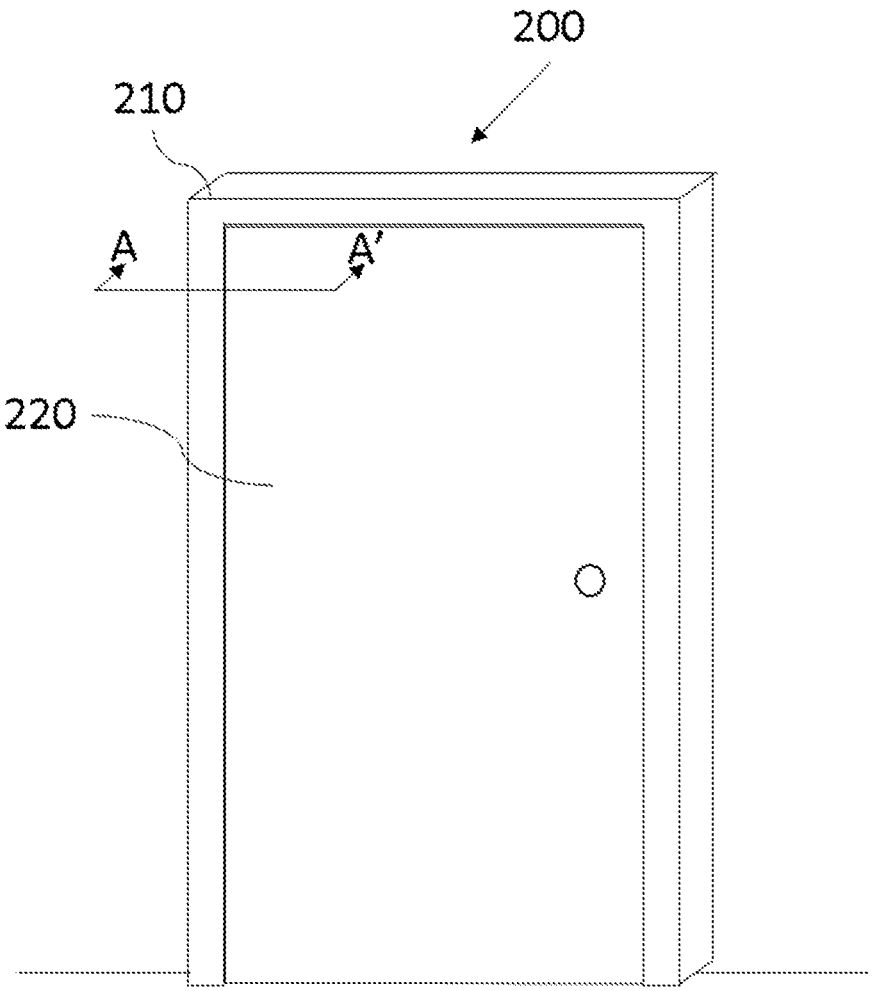
FIG. 8 is a schematic diagram of a door according to one or more embodiments of the present disclosure, where a door body thereof is in a closed position.
Figure 9:
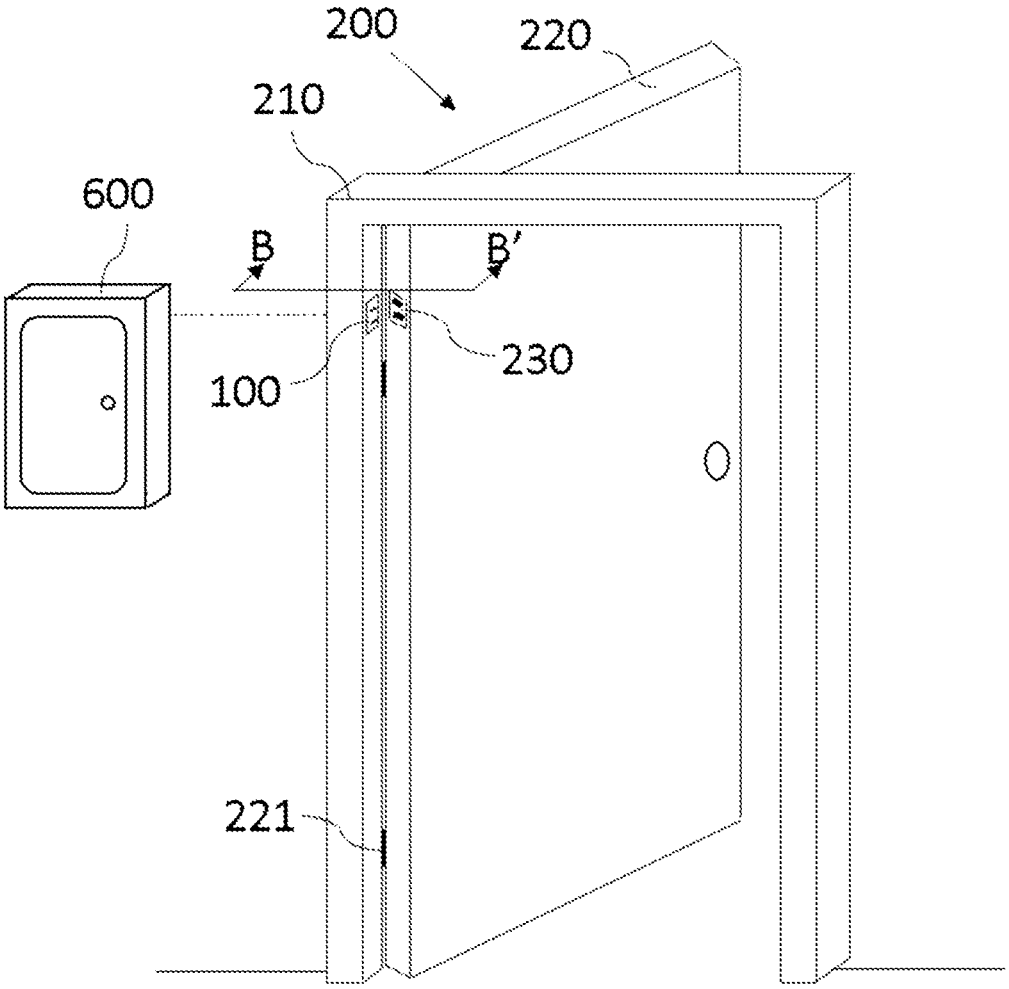
FIG. 9 is a schematic diagram of a door according to one or more embodiments of this disclosure, where the door body is in an open position.

FIG. 8 is a schematic diagram of a door according to one or more embodiments of the present disclosure, where a door body is in a closed position. FIG. 9 is a schematic diagram of a door according to one or more embodiments of this disclosure, where the door body is in an open position.

As shown in FIG. 8 and FIG. 9, the door 200 may include a door frame 210, a door body 220, a socket 100 and a plug 230.

The door frame 210 is used for fixing to a wall. The door frame 210 may include four sides, namely a first side, a second side, a third side and a fourth side. The first side may be opposite to the second side, and the third side may be opposite to the fourth side. The first side faces outdoors, the second side faces indoors, the third side faces the door body 220 (when the door body 220 is in a closed position), and the fourth side faces a wall or is embedded in a wall. The door body 220 is hinged to the door frame 210 by a hinge 221 and may pivot between an open position (shown in FIG. 9) and a closed position (shown in FIG. 8) relative to the door frame 210. The socket 100 may be fixed on the door frame 210 and electrically connected to the distribution box 600 located on the wall. The plug 230 may be fixed to the door body 220. In some embodiments, the socket 100 may further include a power adapter for converting AC power of the distribution box 600 into DC power for using of other devices on the smart door.

Figure 10:
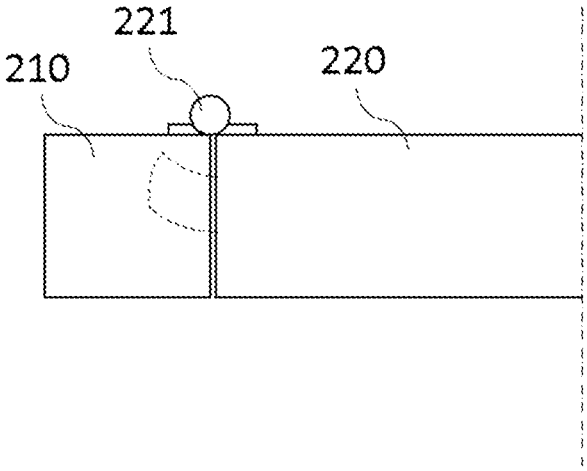
FIG. 10 is a schematic plan view of a door according to one or more embodiments of this disclosure, where a door body is in a closed position.
Figure 11:
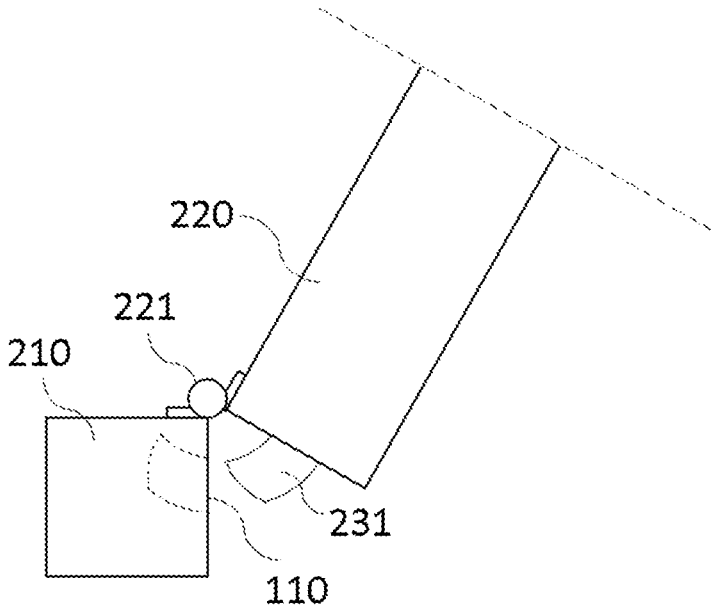
FIG. 11 is a schematic plan view of a door according to one or more embodiments of this disclosure, where the door body is in an open position.

FIG. 10 is a schematic plan view of a door according to one or more embodiments of this disclosure (sectional top view taken along line AA' in FIG. 8), where a door body is in a closed position. FIG. 11 is a schematic plan view of a door according to one or more embodiments of this disclosure (sectional top view taken along line BB' in FIG. 9), where the door body is in an open position.

As shown in FIG. 10 and FIG. 11, the plug 230 may include a connecting pin 231. The socket 100 may include an insertion hole 110 for receiving the connecting pin 231. Both the connecting pin 231 and the insertion hole 110 are arc-shaped, and the center of the arc-shaped is located on the rotation axis of the hinge 221. The insertion hole 110 of the socket 100 may be located on a side (e.g., a third side) of the door frame 210 facing the door body 220 (when the door body 220 is in a closed position).

The plug 230 may be oriented opposite to the socket 100 (i.e., facing the door frame 210) such that the connecting pin 231 of the plug 230 are inserted into the insertion hole 110 of the socket 100 when the door body 220 is in the closed position, and the connecting pin 231 of the plug 230 are disengaged from the insertion hole 110 of the socket 100 when the door body 220 is in the open position. In some embodiments, the positions of the plug 230 and the socket 100 may be interchanged, that is, the plug 230 may be arranged on the door frame 210 and the socket 100 may be arranged on the door body 220.

For a smart door, a surveillance device (e.g., a digital door viewer) is installed on the door body 220, and the monitoring device may be connected to a distribution box located in a wall through wires for power supply. In this case, the wire usually needs to pass through the door body 220, the door frame 210 and the wall. Because the door body 220 and the door frame 210 often move relatively, the wire often bends back and forth and is easily damaged. The connection mode of plug and socket may avoid the damage of wires due to frequent bending. In addition, plugs and sockets may be produced in a modular way, so it is easier to replace the plugs and sockets compared with wires.

In some embodiments, the socket 100 may also be provided with an insertion hole 110 on one side (e.g., the first side) of the door frame 210 facing the outside, so as to supply power to equipment outside the house. For example, when the user is accidentally locked out of the door and the cell phone is about to run out of power while waiting for other family members to open the door, it may be charged through the insertion hole facing the outside. For another example, when a user comes home from work and needs to charge his electric bicycle at night, wiring from inside to outside may cause the door to be unable to close, and there is a potential safety hazard at night. This problem may be perfectly solved through the insertion hole facing outside.

In some embodiments, the socket 100 may also be provided with an insertion hole 110 on one side (e.g., the second side) of the door frame 210 facing the room, so as to supply power to equipment in the room.

Figure 12:
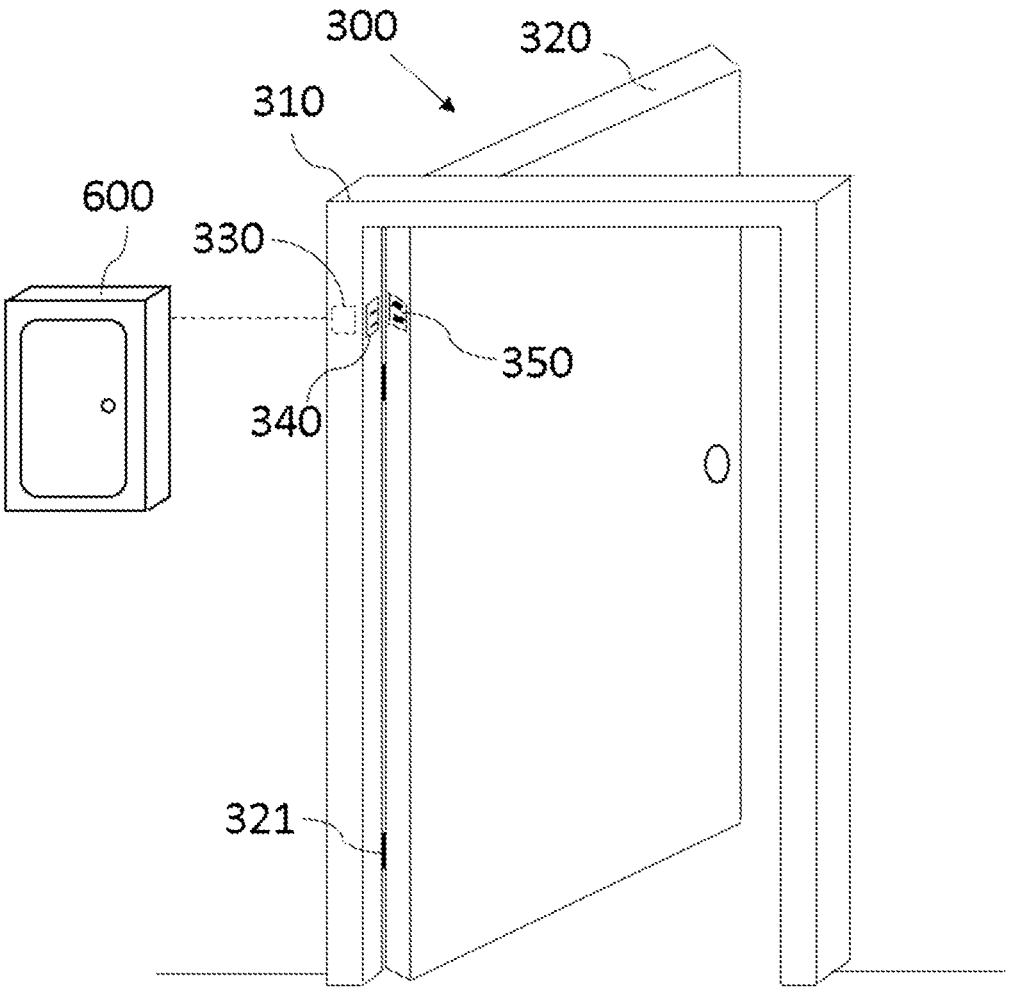
FIG. 12 is a schematic diagram of a door according to one or more embodiments of the present disclosure.

FIG. 12 is a schematic diagram of a door according to one or more embodiments of the present disclosure.

As shown in FIG. 12, in some embodiments, a door 300 may include a door frame 310, a door body 320, a socket 330 (shown in dashed lines), a first wireless power transmission device 340, and a second wireless power transmission device 350.

The door frame 310 is used for fixing to a wall. The door body 320 is hinged to the door frame 310 by a hinge 321 and may pivot between an open position and a closed position relative to the door frame 310. The socket 330 may be buried in the door frame 310 and may be electrically connected to the distribution box 600 located on the wall to take electricity from the distribution box 600. The first wireless power transmission device 340 may be set on the door frame 310 and electrically connected to the socket 330. The second wireless power transmission device 350 may be set on the door body 320.

The first wireless power transmission device 340 and the second wireless power transmission device 350 may be configured such that when the door body 320 is in a closed position, the first wireless power transmission device 340 is closely attached to the second wireless power transmission device 350 for wireless power transmission, and when the door body 320 is in an open position, the first wireless power transmission device 340 is separated from the second wireless power transmission device 350, thereby interrupting the wireless power transmission.

Figure 13:
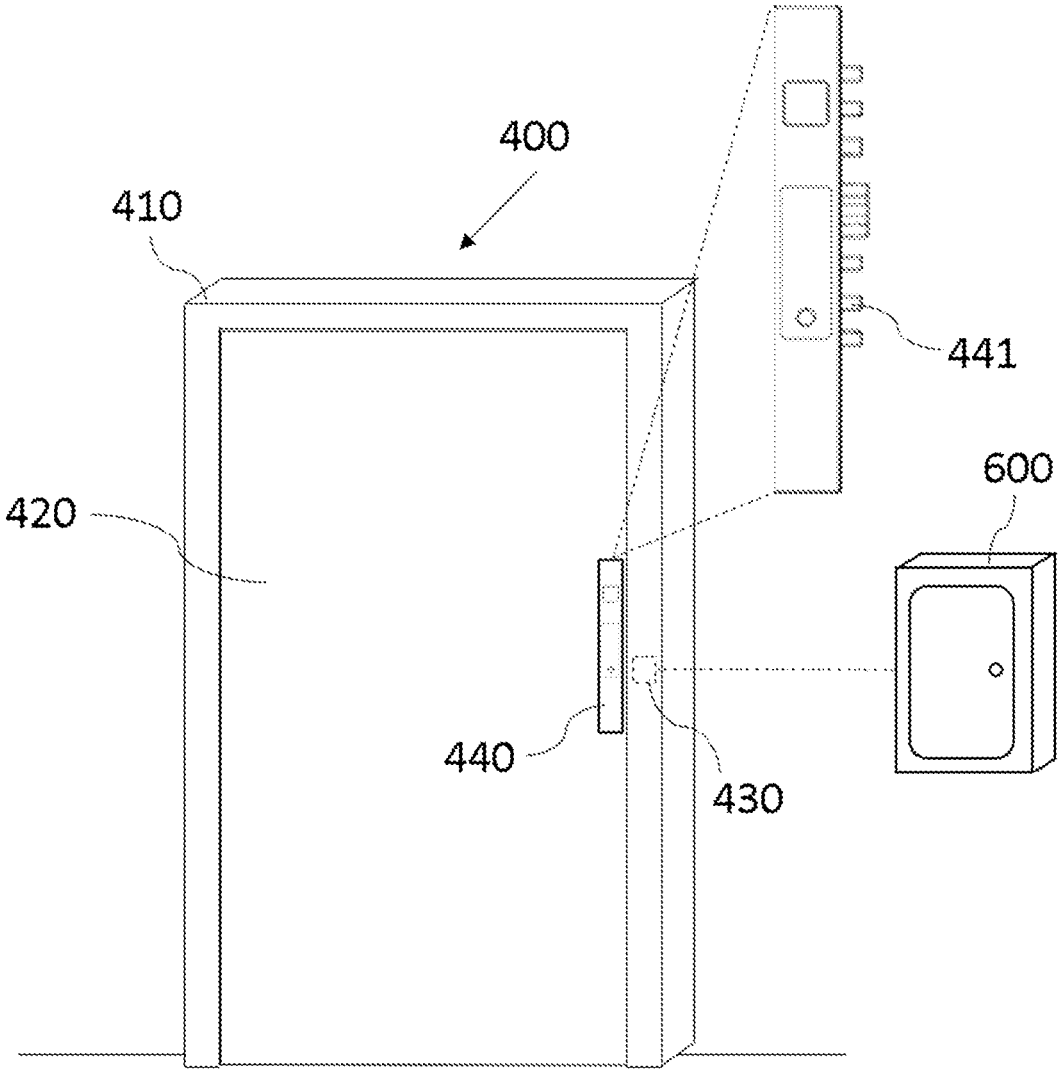
FIG. 13 is a schematic diagram of a door according to one or more embodiments of the present disclosure.

FIG. 13 is a schematic diagram of a door according to one or more embodiments of the present disclosure.

As shown in FIG. 13, a door 400 may include a door frame 410, a door body 420, a socket 430 and a lock 440.

The door frame 410 is used for fixing to a wall. The door body 420 is hinged to the door frame 410 by a hinge (not shown) and may pivot between an open position and a closed position relative to the door frame 410. The socket 430 may be set on a side of the door frame 410 facing the lock 440 (when the door body 420 is in a closed position) and may be electrically connected to the distribution box 600 located on the wall. The lock 440 may be set on the door body 420. The lock 440 may include a bolt 441 and a bolt driving device. The bolt 441 may be made of a conductive material. The socket 430 includes an insertion hole, and the size of the bolt 441 is designed to match the insertion hole of the socket 430.

The bolt 441 and the socket 430 are configured such that when the door body 420 is in the closed position, the bolt 441 is aligned with the insertion hole of the socket 430.

The bolt driving device may be configured to drive the bolt 441 to move linearly to enter and electrically contact the insertion hole when the bolt 441 is aligned with the insertion hole of the socket 430. The bolt driving device may include a driving motor, a worm gear and a worm. The driving motor is configured to perform rotary motion, the worm gear and the worm are used for converting the rotary motion of the output shaft of the driving motor into linear motion.

The lock 440 may be a smart lock, which may be charged through the electrical connection between the socket 430 and the bolt 441. The smart lock may also be configured to receive power from the distribution box 600 only when the door body 420 is in the closed position.

In summary, after reading this detailed disclosure, those skilled in the art may understand that the foregoing detailed disclosure may be presented by way of example only and may not be restrictive. Although not explicitly stated here, those skilled in the art will understand that this disclosure is intended to cover various reasonable changes, improvements and modifications to the embodiments. These changes, improvements and modifications are intended to be proposed by this disclosure and are within the spirit and scope of the exemplary embodiments of this disclosure.

What is claimed is:

1. A socket, comprising:

an input terminal configured to be electrically connected to an AC power source;

an output terminal configured to output an AC signal;

a switch circuit electrically connected between the input terminal and the output terminal;

a step-down circuit electrically connected to the input terminal and configured to reduce the amplitude of the AC signal;

a shaping circuit electrically connected to the step-down circuit and configured to convert the AC signal with reduced amplitude into a shaped signal; and a control circuit electrically connected to the shaping circuit and the switch circuit and configured to control the switch circuit based on the shaping signal to enable the switch circuit to perform switching operation only when the AC signal is at zero potential.

2. The socket according to claim 1, wherein, the switch circuit comprises a relay electrically connected to the input terminal and the output terminal, the control circuit is configured to generate a control signal for controlling the relay based on the shaped signal to enable contacts of the relay to be attracted or released only when the AC signal is at zero potential.

3. The socket according to claim 2, wherein the control signal comprises a first trigger edge and a second trigger edge, the first trigger edge is used for triggering the contact of the relay to attract, and the second trigger edge is used for triggering the release of the contact of the relay, the appearance time of the first trigger edge is determined according to the zero crossing time of the AC signal, the transition time of the shaped signal and the attracting transition time of the relay, the appearance time of the second trigger edge is determined according to the zero crossing time of the AC signal, the transition time of the shaped signal and the release transition time of the relay.

4. The socket according to claim 3, wherein a delay time of the first trigger edge compared with the rising edge of the shaped signal is calculated according to the following formula:

$$T_{x1}=n\times z-a-b,$$

wherein, $T_{x1}$ is the delay time between the first trigger edge and the rising edge of the shaped signal, a is the time between the zero-crossing time of the AC signal from negative half cycle to positive half cycle and the rising edge time of the shaped signal in the positive half cycle, z is the half cycle of the AC signal, b is the attracting transition time of the relay, and n is a positive integer.

5. The socket according to claim 3, wherein a delay time of the first trigger edge compared with the falling edge of the shaped signal is calculated according to the following formula:

$$T_{y1}=n\times z+a-b,$$

wherein, $T_{y1}$ is the delay time between the first trigger edge and the falling edge of the shaped signal, a is the time between the zero-crossing time of the AC signal from negative half-cycle to positive half-cycle and the rising edge time of the shaped signal in the positive half-cycle, z is the half-cycle of the AC signal, b is the attracting transition time of the relay, and n is a positive integer.

6. The socket according to claim 3, wherein a delay time of the second trigger edge compared with the rising edge of the shaped signal is calculated according to the following formula:

$$T_{x2}=n\times z-a-c,$$

wherein, $T_{x2}$ is the delay time of the second trigger edge compared with the rising edge of the shaped signal, a is the time between the zero crossing time of the AC signal from negative half cycle to positive half cycle and the rising edge time of the shaped signal in the positive half cycle, z is the half cycle of the AC signal, c is the release transition time of the relay, and n is a positive integer.

7. The socket according to claim 3, wherein a delay time of the second trigger edge compared with the falling edge of the shaped signal is calculated according to the following formula:

$$T_{y2}=n\times z+a-c,$$

wherein, $T_{y2}$ is the delay time between the second trigger edge and the falling edge of the shaped signal, a is the time between the zero-crossing time of the AC signal from negative half-cycle to positive half-cycle and the rising edge time of the shaped signal in the positive half-cycle, z is the half-cycle of the AC signal, c is the release transition time of the relay, and n is a positive integer.

8. The socket according to claim 2, wherein the step-down circuit comprises:

a first resistor, a first end of the first resistor is electrically connected to the input terminal; and a second resistor, a first end of the second resistor is electrically connected to a second end of the first resistor, the second end of the second resistor is grounded, wherein, the resistance value of the second resistor is 0.5% to 1.5% of the resistance value of the first resistor.

9. The socket according to claim 8, wherein the shaping circuit comprises:

an NMOSFET, the source of which is grounded;

a third resistor, the first end of which is electrically connected to the first end of the second resistor, and the second end of which is electrically connected to the gate of the NMOS field effect transistor;

a fourth resistor, a first end of which is electrically connected to the working voltage, and a second end of which is electrically connected to the drain of the NMOS field effect transistor; and a first capacitor, a first end of which is electrically connected to the gate of the NMOS field effect transistor, and a second end of which is grounded.

10. The socket according to claim 9, wherein an AC signal input end of the relay is electrically connected to the input terminal, an AC signal output end of the relay is electrically connected to the output terminal, and a first control end of the relay is connected to the working voltage, the switch circuit further comprises:

a triode, the collector of which is electrically connected to the second control end of the relay, and the emitter of which is grounded;

a fifth resistor, a first end of which is electrically connected to the control signal output end of the control circuit, and a second end of which is electrically connected to the base of the triode;

a first diode, the anode of which is electrically connected to the second end of the fifth resistor, and the cathode of which is electrically connected to the first end of the fifth resistor;

a second diode, the anode of which is electrically connected to the second control end of the relay, and the cathode of which is electrically connected to the first control end of the relay;

a second capacitor, a first end of which is electrically connected to a second end of the fifth resistor, the second end of which is grounded;

a third capacitor, a first end of which is electrically connected to the operating voltage, and a second end of which is grounded; and a fourth capacitor, a first end of which is electrically connected to the operating voltage, and a second end of which is grounded.

11. The socket according to claim 1, wherein the step-down circuit is configured to reduce the amplitude of the AC signal to 0.5% to 1.5% of its initial value.

12. The socket according to claim 1, wherein the switch circuit is configured to control connection and disconnection between the input terminal and the output terminal.

13. The socket according to claim 1, wherein the step-down circuit is configured to reduce the amplitude of the AC signal by dividing the AC signal of the AC power supply.

14. The socket according to claim 1, further comprising: a first phase detection circuit configured to detect the phase of the AC signal and a second phase detection circuit configured to detect the phase of the shaping signal.

15. A door, comprising:

a door frame for fixing to a wall;

a door body connected to the door frame by a hinge to enable the door body to pivot between an open position and a closed position relative to the door frame; and a socket, comprising:

an input terminal configured to be electrically connected to an AC power source;

an output terminal configured to output an AC signal;

a switch circuit electrically connected between the input terminal and the output terminal;

a step-down circuit electrically connected to the input terminal and configured to reduce the amplitude of the AC signal;

a shaping circuit electrically connected to the step-down circuit and configured to convert the AC signal with reduced amplitude into a shaped signal; and a control circuit electrically connected to the shaping circuit and the switch circuit and configured to control the switch circuit based on the shaping signal to enable the switch circuit to perform switching operation only when the AC signal is at zero potential.

16. The door according to claim 15, further comprising:

a plug fixed on the door body, wherein, the plug and the socket are configured such that the plug is inserted into the socket when the door body is in a closed position, and the plug is separated from the socket when the door body is in an open position.

17. The door according to claim 16, wherein the plug comprises a connecting pin, and the socket comprises an insertion hole for receiving the connecting pin, wherein the insertion hole is located at one side of the door frame facing the door body.

18. The door according to claim 17, wherein the connecting pin and the insertion hole are both arc-shaped, and the center of the arc-shaped is located on the rotation axis of the hinge.

19. The door according to claim 15, further comprising:

a second wireless power transmission device arranged on the door frame and electrically connected with the socket; and a first wireless power transmission device arranged on the door body;

wherein, the first wireless power transmission device and the second wireless power transmission device are configured to cling to the second wireless power transmission device for wireless power transmission when the door body is in the closed position, and separate from the second wireless power transmission device when the door body is in the open position.

20. The door according to claim 15, further comprising:

a lock fixed on the door body and comprises a bolt and a bolt driving device, wherein, the bolt and the socket are configured such that when the door body is in the closed position, the bolt is aligned with the insertion hole of the socket, wherein, the bolt driving device is configured to drive the bolt into the insertion hole when the bolt is aligned with the insertion hole of the socket.

* * * * *